United States Patent [19]

Jarosky

[11] Patent Number: 4,871,082

[45] Date of Patent: Oct. 3, 1989

[54] SERVING ENSEMBLE FOR HOLDING HOT COOKED MEAT

[76] Inventor: John R. Jarosky, 106 N. Main, Glenwood, Ill. 60425

[21] Appl. No.: 212,685

[22] Filed: Jun. 28, 1988

[51] Int. Cl.[4] ..... B65D 25/00

[52] U.S. Cl. ..... 220/22; 220/408; 220/83

[58] Field of Search ..... 220/22, 408, 83

[56] References Cited

U.S. PATENT DOCUMENTS

| | | | |
|---|---|---|---|
| 231,034 | 8/1880 | Goessling | 220/22 |
| 908,723 | 1/1909 | Anderson | 220/22 |
| 922,495 | 5/1909 | Lust | 220/22 |
| 1,595,356 | 8/1926 | Moseman | 220/22 X |
| 1,756,963 | 5/1930 | Ware | 220/22 |
| 2,174,586 | 10/1939 | Leppke | 220/22 |
| 2,549,440 | 4/1951 | Erro | 220/22 X |
| 3,164,285 | 1/1965 | Melich | 220/408 |

*Primary Examiner*—Steven M. Pollard
*Attorney, Agent, or Firm*—Philip Hill

[57] ABSTRACT

This invention relates to means for retaining enough of the heat of a hot cooked meal while the meat is being consumed, to enhance the pleasure of eating the entire meal.

6 Claims, 1 Drawing Sheet

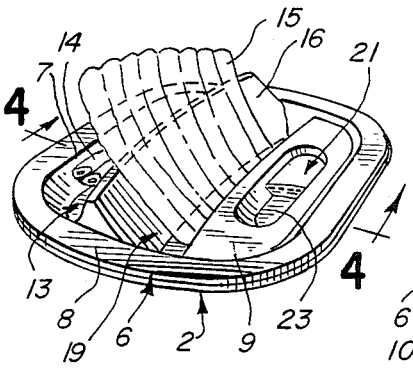
FIG. 1
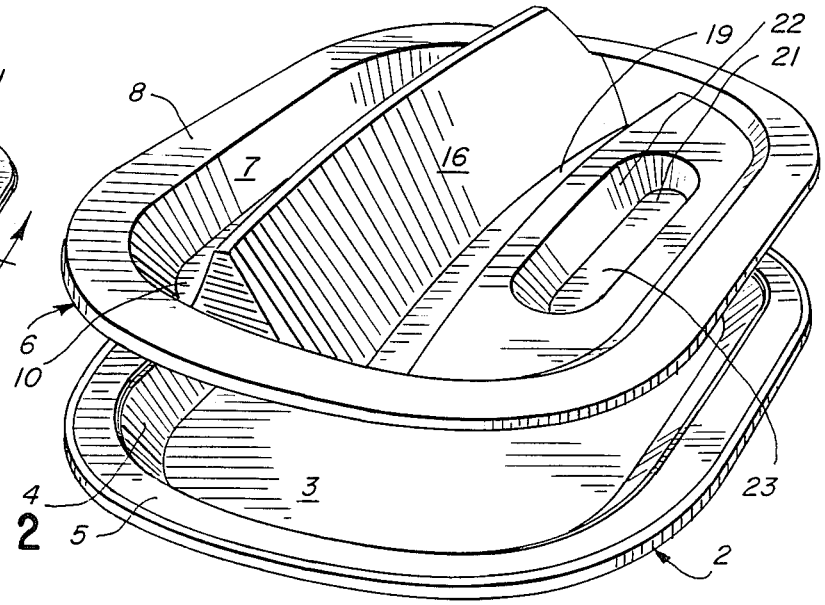
FIG. 2
FIG. 3
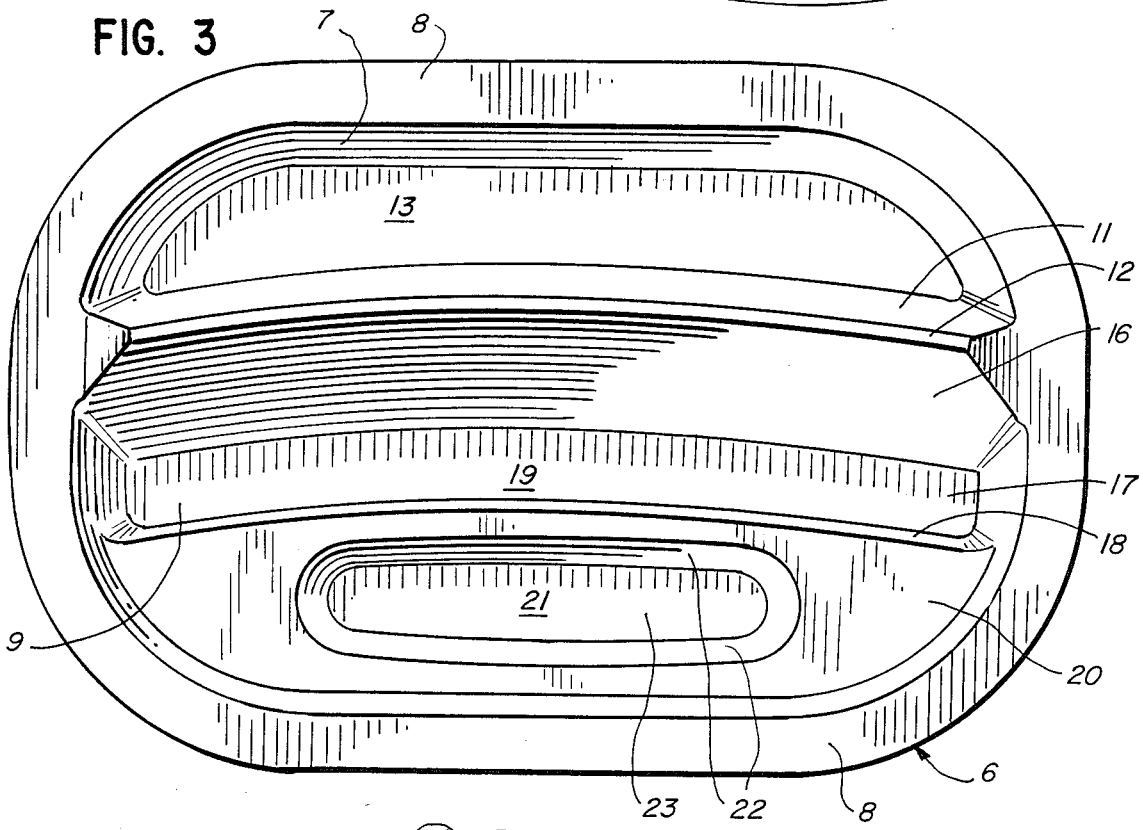
FIG. 4
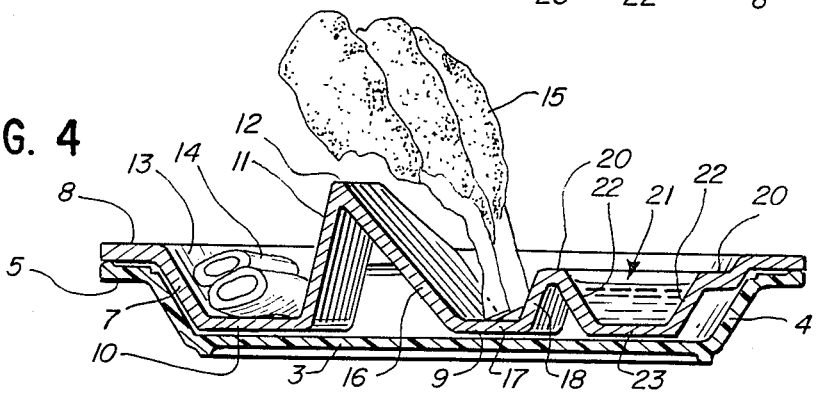

SERVING ENSEMBLE FOR HOLDING HOT COOKED MEAT

FIELD OF THE INVENTION

Although the invention relates to a serving ensemble capable of retaining the heat of a hot cooked meal for a period of time long enough to permit a person to eat the complete meal before it has cooled to a degree sufficient to spoil the enjoyment of the person eating the meal, it is particularly adapted to hold a cooked slab of spare ribs as it is served in a restaurant.

SUMMARY OF THE INVENTION

The palatability of a serving of cooked spare ribs is enhanced by the retention of a considerable portion of the heat as the ribs are being consumed. This is particularly true in a restaurant where most customers are reluctant to send the ribs back to the kitchen to be reheated. The present invention comprises a serving ensemble consisting of a metal tray that is heated before the ribs are placed therein, and is capable of retaining the heat for a considerable length of time, and a second tray of plastic or other non-heat-conducting material adapted to hold the hot tray so that the ribs may be served to a restaurant patron while they are still hot. The metal tray is provided with three separate compartments, one for holding the ribs, one for holding the sauce for the ribs, and one for holding the bones discarded from the ribs as the meat is consumed.

BRIEF DESCRIPTION OF THE DRAWINGS

FIG. 1 is a perspective view of a serving ensemble embodying a preferred embodiment of the invention;

FIG. 2 is a perspective view of the rib holding metal tray spaced above the lower plastic tray into which the rib holding tray is adapted to fit;

FIG. 3 is a top elevational view illustrating the compartmental configuration of the rib holding tray; and FIG. 4 is a cross-sectional view taken along the line 4-4 of FIG. 1.

DESCRIPTION OF THE PREFERRED EMBODIMENT

In the drawings, a lower tray 2 of plastic or any suitable non-heat-conducting material comprises a flat bottom wall 3, an upstanding peripheral wall 4, and an outwardly extending ledge 5 parallel to the bottom wall. The lower tray may be of any desired shape, but is preferably in the shape of an elongated oval. The plastic is thick enough to permit a person, such as a waiter or waitress, to safely hold the ensemble without getting burned when a hot object is placed in the tray.

An upper tray 6 of metal or other suitable heat-conducting material is shaped to conform to the shape of the plastic tray 2 and is dimensioned to fit within the plastic tray. The upper tray may be molded, but is preferably stamped out of sheet metal to lower the production costs. The metal must be of sufficient thickness to retain heat applied thereto for a period of time long enough to enable a person eating meat served to him in heated condition to consume all of the meat while it is still hot. The metal tray is kept in an oven until the ribs are placed in it so that the metal tray will not absorb any heat from the ribs when they are placed in the tray. The plastic tray is kept away from the oven, so that when the hot metal tray, with the hot cooked ribs, is placed in the plastic tray, the waiter or waitress may handle the ensemble without getting burned.

The upper tray 6 has an upstanding peripheral wall 7 fitting within the peripheral wall 4 of the lower tray and an outwardly extending ledge 8 adapted to rest on the ledge 5 of the lower tray. The upper tray is particularly designed to hold a slab of spare ribs, and its bottom wall 9 has a section 10 adapted to rest on the bottom wall 3 of the lower tray when the upper tray is positioned in the lower tray. The section 10 of the bottom wall of the upper tray terminates in an upstanding wall 11 that defines one side of a ridge 12 extending longitudinally of the upper tray. The ridge 12 cooperates with a portion of the wall 7 to form a compartment 13 for holding the bones 14 discarded from the spare ribs 15 as the meat of the ribs is consumed. The opposite side of the ridge 12, remote from the compartment 13, comprises as a wall 16 extending downwardly from the top of the ridge to the bottom of the upper tray 6. The lower edge of the wall 16 extends outwardly a short distance, as indicated at 17 in FIG. 4, and then upwardly, as indicated at 18, to form a compartment 19 adapted to hold one edge of a slab of spare ribs. The upwardly extending wall 18 holds one edge of the slab of spare ribs against slipping so that the slab is held in substantially upright position. Each slab of ribs is preferably sliced between the individual ribs throughout most of the length of ribs before it is served to that the restaurant patron to whom the ribs are served may easily break individual ribs from the slab.

The section 20 of the bottom wall 9 of the upper tray 6 between the compartment 19 and the outer peripheral wall 7 is spaced above the bottom wall of the lower tray when the upper tray is positioned within the lower tray. This arrangement permits a portion of the section 20 to be depressed, as shown in FIG. 4, to form a third compartment 21 for holding sauce that is usually served with an order of spare ribs. The compartment 21 is defined by side walls 22 depending from the section 20 and a bottom wall 23.

I claim:

1. A compartmented metal serving tray comprising an upstanding peripheral wall, said peripheral wall describing the external dimensions of said tray, together with first, second, and third elongated walled compartments contained within said peripheral wall, said compartments extending longitudinally of said tray and being aligned laterally of said tray, said second elongated compartment having a canted longitudinal area extending substantially vertically for a significant distance above the horizontal plane generally described by said tray, whereby a cooked portion of meat may be displayed and served upon said canted area.

2. The serving tray of claim 1 wherein the canted longitudinal area comprises a bottom section of said second elongated compartment, said canted area being created by extending one longitudinal wall section of said second compartment substantially vertically above the horizontal plane generally described by said tray.

3. The serving tray of claim 1 wherein the first elongated walled compartment describes a container for meat sauces.

4. The serving tray of claim 1 wherein the third elongated walled compartment describes a receptacle for waste elements of the cooked portion of meat.

5. The serving tray of claim 1 wherein the second elongated compartment displays a cooked slab of beef or pork spare ribs, the first elongated compartment contains a suitable meat sauce, and the third elongated compartment is provided as a receptacle for discarded bones.

6. A serving ensemble comprising the compartmented serving tray of claim 1 supported by a separate, fitted tray constructed of non-heat-conducting material.

* * * * *